US005111600A

United States Patent [19]

Lukavich et al.

[11] Patent Number: 5,111,600

[45] Date of Patent: May 12, 1992

[54] TOOTH WITH HARD MATERIAL APPLIED TO SELECTED SURFACES

[75] Inventors: Paul J. Lukavich, Washington; Joseph W. Puckett, Peoria, both of Ill.

[73] Assignee: Caterpillar Inc., Peoria, Ill.

[21] Appl. No.: 739,127

[22] Filed: Jul. 30, 1991

[51] Int. Cl.[5] ..... E02F 9/28

[52] U.S. Cl. ..... 37/141 T; 37/142 R

[58] Field of Search ..... 37/141 T, 142 R, 141 R, 37/103

[56] References Cited

U.S. PATENT DOCUMENTS

| | | | |
|---|---|---|---|
| 3,286,379 | 11/1966 | Benetti . | |
| 3,790,353 | 2/1974 | Jackson et al. | 37/142 R X |
| 3,805,423 | 4/1974 | Engel et al. | 37/142 R |
| 3,970,445 | 7/1976 | Gale et al. . | |
| 4,083,605 | 4/1978 | College et al. | 299/91 |
| 4,170,267 | 10/1979 | Bourlier | 37/142 R X |
| 4,187,626 | 2/1980 | Greer et al. | 37/141 R |
| 4,713,897 | 12/1987 | Hemphill | 37/142 R X |

*Primary Examiner*—Dennis L. Taylor
*Assistant Examiner*—J. Russell McBee
*Attorney, Agent, or Firm*—J. W. Burrows

[57] ABSTRACT

Teeth are normally mounted to the cutting edge of a bucket to aid in the penetration of the material being worked. Furthermore, hard material has been applied to selected surfaces of the teeth to increase their wear life. It is advantageous to strategically size and position the application of hard material to the tooth in order to increase wear life and to simultaneously enhance the ability of the tooth to remain sharp for better penetration during the useful life of the tooth. In the subject arrangement, a first portion of hard material having a predetermined width and length is applied to a bottom surface of a tooth and a second portion of hard material having a predetermined width less than the width of the first portion of hard material is applied to a top surface of the tooth. The first and second portions of hard material are applied extending from adjacent a transverse forward edge in a longitudinal direction. The width relationship between the first and second portions of hard material and the location of the first and second portions of hard material both increase the wear life of the tooth and maintains the sharpness of the tooth during its useful life for better penetration of the material being worked.

10 Claims, 4 Drawing Sheets

TOOTH WITH HARD MATERIAL APPLIED TO SELECTED SURFACES

TECHNICAL FIELD

This invention relates generally to an earth penetrating tooth and more particularly to a tooth having a hard material applied to selected surfaces of the tooth.

BACKGROUND ART

It is well-known that when teeth, such as bucket teeth, are used in abrasive conditions, the material of each tooth wears at a quick rate due to the abrasive action of the material being worked. The increased wear rate shortens the useable life of the tooth plus during use the tooth normally becomes blunt as illustrated in FIG. 21 of U.S. Pat. No. 4,187,626 issued Feb. 12, 1980 to D. J. Greer, et al. As the tooth becomes blunt due to wear, its ability to penetrate the material being worked is decreased. Forcing a blunted tooth to penetrate the material being worked requires additional effort, thus reducing operating efficiency.

Attempts have been made to increase wear life and maintain sharpness during the useful life of the tooth. Two examples are U.S. Pat. Nos. 3,286,379 and 3,805,423 each respectively issued Nov. 22, 1966 to J. G. Benetti and Apr. 23, 1974 to H. L. Engel, et al. Each of these patents illustrate the application of a hard material insert or a hard weld material being applied to the top surface of the tooth. These designs would appear to aid in increasing wear life and maintaining a degree of sharpness during the useful life of the tooth. However, in each case, the bottom surface of the respective teeth are still subjected to increased wear rates since the unprotected bottom surface of each tooth is still in direct contact with the material being worked.

Another attempt of increasing wear life while maintaining sharpness is illustrated in U.S. Pat. No. 4,083,605 which issued Apr. 11, 1978 to M. A. College, et al. The tooth of this design is designed for use on a ripper. The tooth has inserts of hard material disposed in a "U" pattern with the legs of the "U" being the leading edge and the trailing edge of the tooth. Once one leg of the "U" is worn away, the tooth can be turned around to expose the unused leg of the "U" pattern for extended life of the tooth. During use on a ripper, only the bottom and the leading leg of the "U" is exposed to wear. Consequently, there is no need to provide added protection to the trailing leg as compared to the need to protect the bottom surface on a bucket tooth.

The present invention is directed to overcoming one or more of the problems as set forth above.

DISCLOSURE OF THE INVENTION

In one aspect of the present invention, a tooth is provided for use on an implement. The tooth includes a proximal end portion adapted for attachment of the tooth to the implement. A distal end portion is also provided and has a top surface, a bottom surface, opposed side surfaces, and a transverse forward edge having a predetermined width. Each of the surfaces extend longitudinally from the proximal end portion to the transverse forward edge. The top surface and the bottom surface converge at the transverse forward edge to form a sharp edge for better penetration. A first portion of hard material having a predetermined width and length is applied to the bottom surface at a location extending from the transverse forward edge longitudinally towards the proximal end portion. The predetermined width of the first portion of hard material is less than the predetermined width of the transverse forward edge. A second portion of hard material having a predetermined width and length is applied to the top surface at a location extending from the transverse forward edge longitudinally towards the proximal end portion. The predetermined width of the second portion of hard material being less than the width of the first portion of hard material. The first portion of hard material in cooperation with the second portion of hard material is operative during the useful life of the tooth to both increase the wear life of the tooth and maintain the sharpness of the tooth for better penetration of the material being worked.

The present invention provides a simple tooth having a hard material applied strategically to the top and bottom surfaces which during use increases the life of the tooth while maintaining sharpness of the tooth for better penetration of material being worked.

BEST MODE FOR CARRYING OUT THE INVENTION

Figure 1:
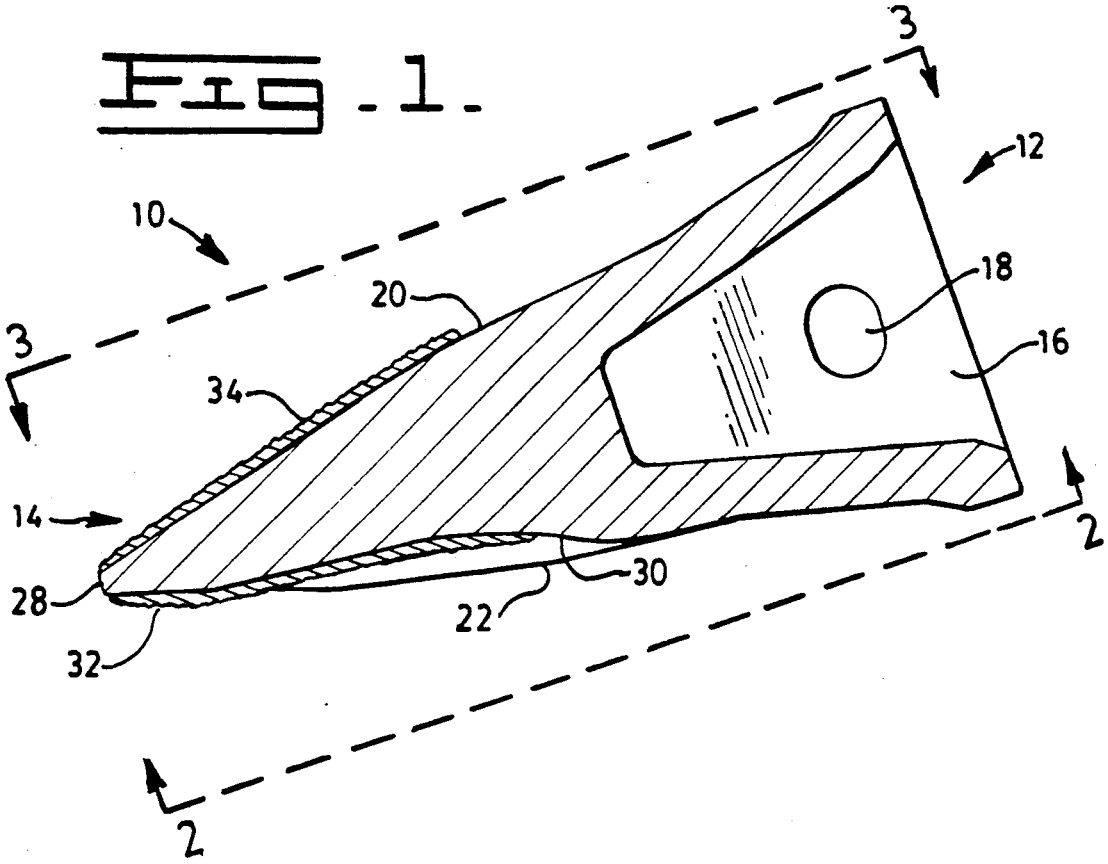
FIG. 1 is a longitudinal sectional view of a tooth incorporating an embodiment of the present invention.
Figure 2:
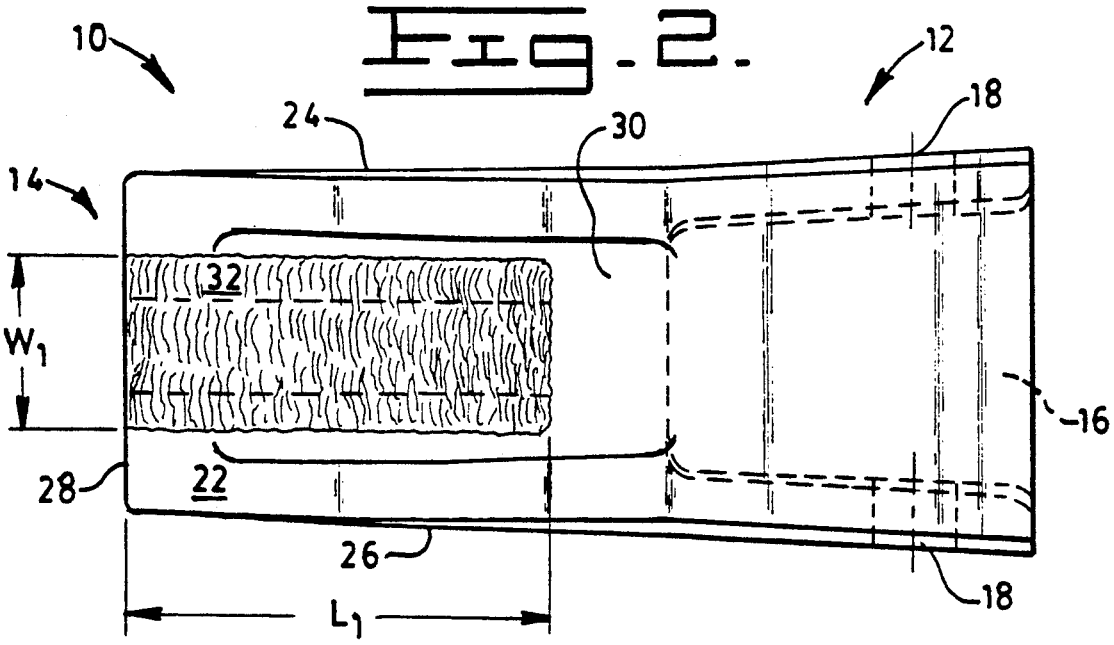
FIG. 2 is a bottom view of the tooth illustrated in FIG. 1.
Figure 3:
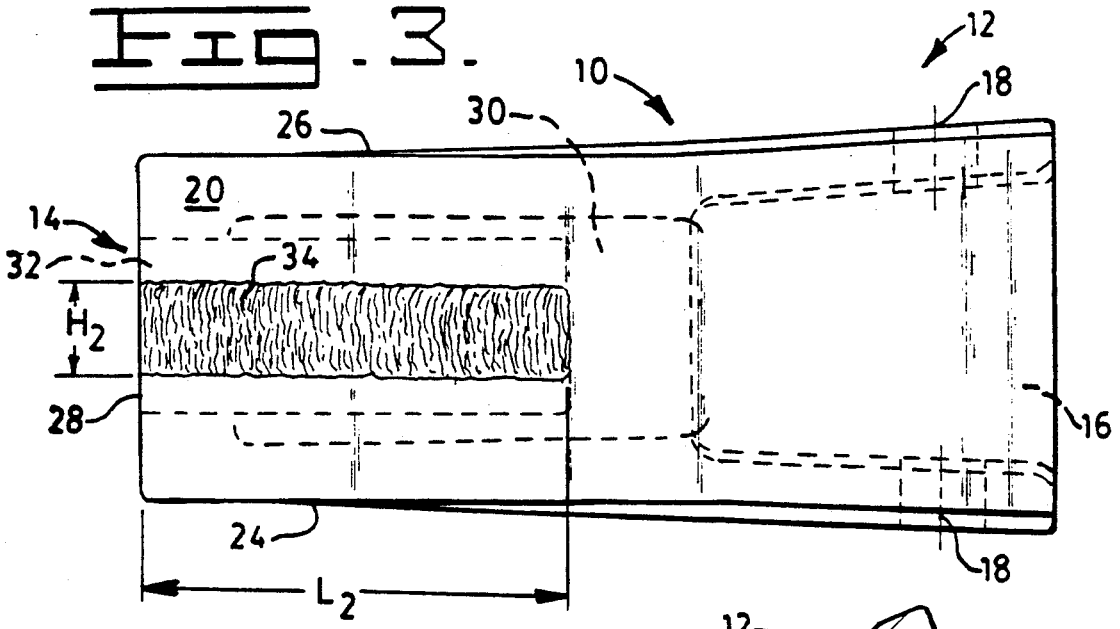
FIG. 3 is a top view of the tooth illustrated in FIG. 1.

Referring to the drawings, and more particularly to FIGS. 1 through 3, a tooth 10 is shown. The tooth 10 is adapted for use, in a well-known manner, on an implement (not shown). The tooth 10 has proximal end portion 12 and a distal end portion 14.

The proximal end portion 12 is adapted for attachment of the tooth 10 to the implement. More specifically, the proximal end portion 12 defines a cavity 16 and a pair of opposed openings 18 on opposite sides of the cavity 16. The cavity 16 is operative to mate with a nose portion of the implement, in a well-known manner, and the opposed openings 18 are operative to receive a pin (not shown) to secure the tooth 10 to the nose portion of the implement.

The distal end portion 14 has a top surface 20, a bottom surface 22, opposed side surfaces 24,26, and a transverse forward edge 28. Each of the surfaces 20,22,24,26 extend longitudinally from the proximal end portion 12 to the transverse forward edge 28.

The top and bottom surfaces 20,22 converge at the transverse forward edge 28 to produce an edge that is generally sharp to provide better penetration of the tooth into the material being worked. The opposed side surfaces 24,26 are generally parallel. It is recognized that the side surfaces could be something other than parallel without departing from the essence of the invention.

A longitudinally extending cavity 30 is defined in the bottom surface 22 of the distal end portion 14. The cavity 30 is centrally located between the opposed side surfaces 24,26 and spaced from the transverse forward edge 28.

A first portion of hard material 32 is applied to the bottom surface 22 of the distal end portion 14. The first portion of hard material 32 is centrally located between the side surfaces 24,26 and extends from adjacent the transverse forward edge 28 towards the proximal end portion 12 and into the longitudinally extending cavity 30. The first portion of hard material 32 has a predetermined width $W_1$ and a predetermined length $L_1$. The predetermined width $W_1$ of the first portion of hard material 32 is generally less than the width of the longitudinally extending cavity 30.

A second portion of hard material 34 is applied to the top surface 2 of the distal end portion 14 centrally located between the side surfaces 24,26 and extends from adjacent the transverse forward edge 28 towards the proximal end portion 12. The second portion of hard material 34 has a predetermined width $W_2$ and a predetermined length $L_2$. The predetermined width $W_2$ of the second portion of hard material 34 is less than the predetermined width $W_1$ of the first portion of hard material 32. More specifically, in the embodiment shown, the width $W_1$ of the first portion of hard material 32 is generally twice as wide as the width $W_2$ of the second portion of hard material 34. The predetermined length $L_2$ of the second portion of hard material 34 is generally the same as the length $L_1$ of the first portion of hard material 32.

In the example illustrated, the first and second portions of hard material 32,34 are applied to the respective top and bottom surfaces 20,22 by bonding the hard material to the respective surfaces of the tooth 10. More specifically, in the subject arrangement, the bonding is accomplished by the adding of hard particles to a pool of molten metal formed by a welding process. This process is commonly referred to as hardsurfacing with abrasion resistant material (ARM). In this process a gas shielded welding process (MIG) is used to create the pool of molten metal and the hard particles are added to the pool of molten metal through a feed tube which closely follows the welding head. The ARM particles used in this process are an alloy comprising general 6–12% boron, 25–61% chromium, and the balance iron. Addition information on the making of the ARM particles may be obtained from a review of U. S. Pat. No. 3,970,445 issued July 20, 1976 to P. L. Gale et al. The consumable weld wire used in this process has a chemical composition that is compatible to the chemical composition of the tooth. It is recognized that many other compounds of hard particles could be used herein without departing from the essence of the invention. For example, tungsten carbide could be used. Likewise, many other techniques could be utilized to bond the first and second portions of hard material 32,34 to the surface of the tooth 10. Furthermore, recesses could be provided on the surfaces so that the hard material may be placed in the recesses. Likewise, the hard material could be in the form of inserts that are braised in the recesses or to the surfaces of the tooth 10. The technique used in applying the hard material to the surface is secondary to the strategic location of the hard material and the relationship between the first and second portions of hard material 32,34.

Figure 4:
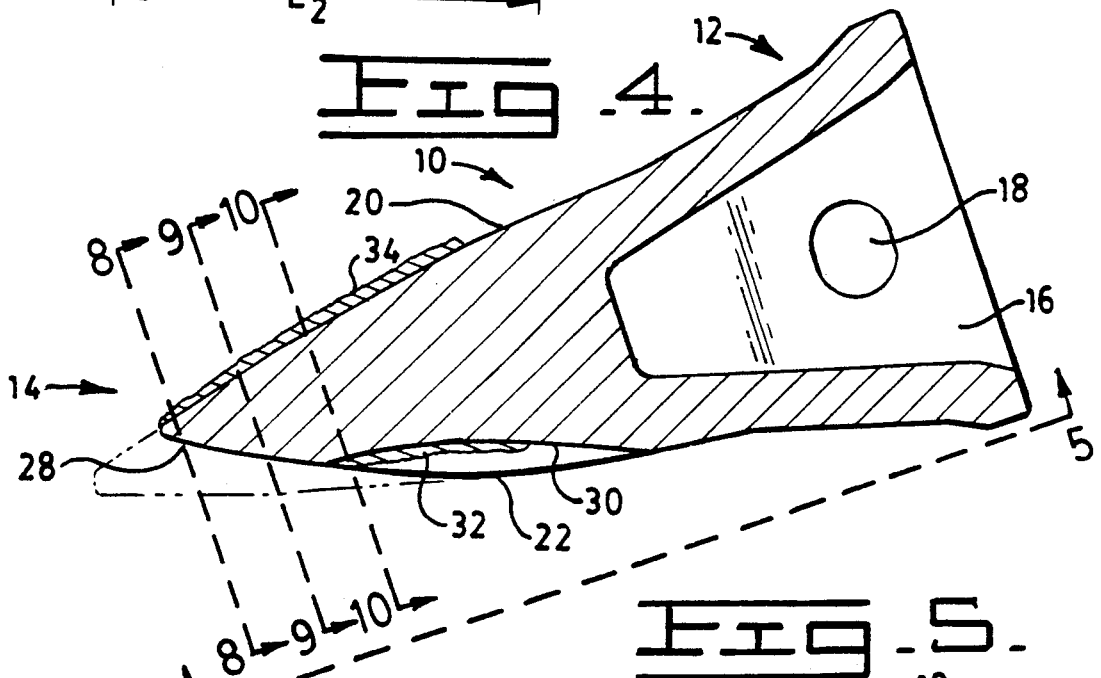
FIG. 4 is a longitudinal sectional view of the tooth illustrated in FIG. 1 with a portion of the tooth worn away.
Figure 5:
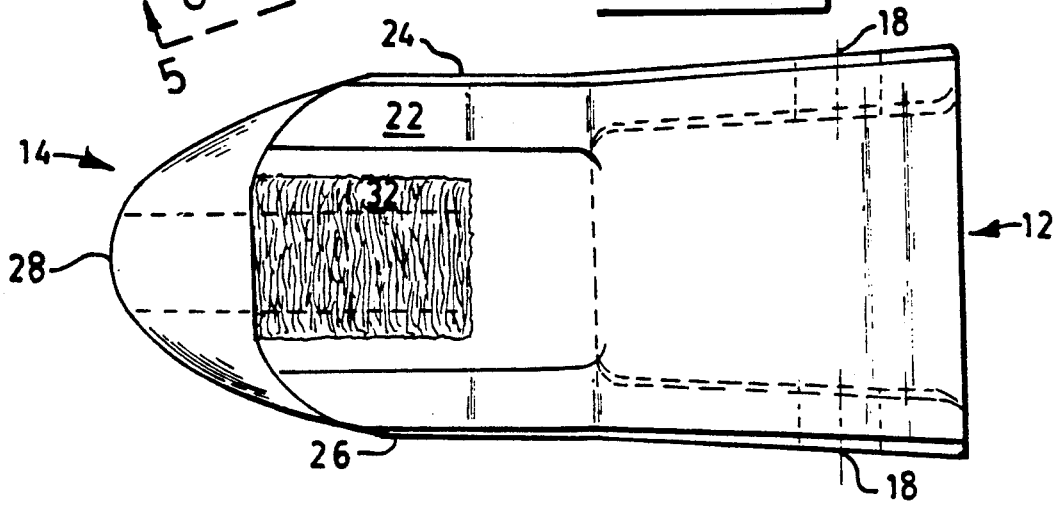
FIG. 5 is a bottom view of the partially worn tooth illustrated in FIG. 4.

Referring now, to FIGS. 4 and 5, the tooth 10 is illustrated to represent a theoretical wear pattern created during use which exemplifies how the tooth 10 retains its ability to better penetrate the material being worked. As can be seen from a review of FIG. 4, the forward end portion of the tooth 10 has been worn away. Noting specifically, that the major wear has been to the bottom surface 22. FIG. 5 illustrates theoretically how the top surface 20 wears at a slower rate and how the sides surfaces 24,26 thereof wear to help maintain a sharper point which better aids in the ability of the tooth to penetrate the material being worked.

Figure 6:
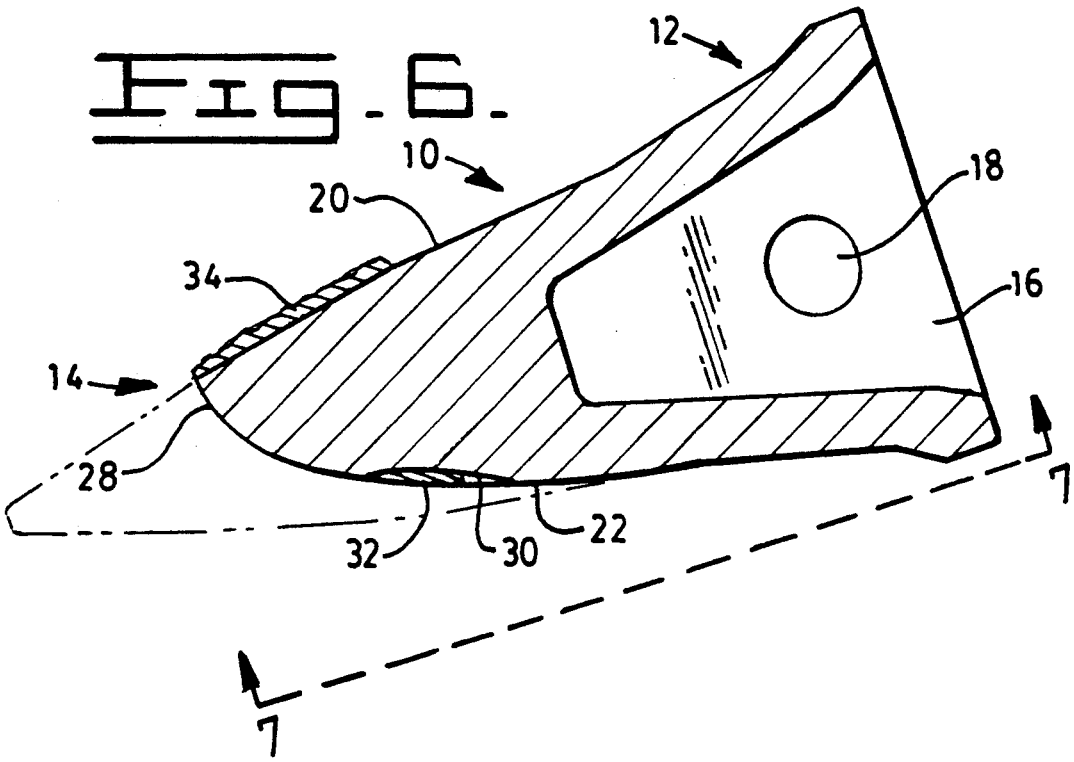
FIG. 6 is a longitudinal sectional view of the tooth of FIG. 1 with a larger portion of the tooth worn away.
Figure 7:
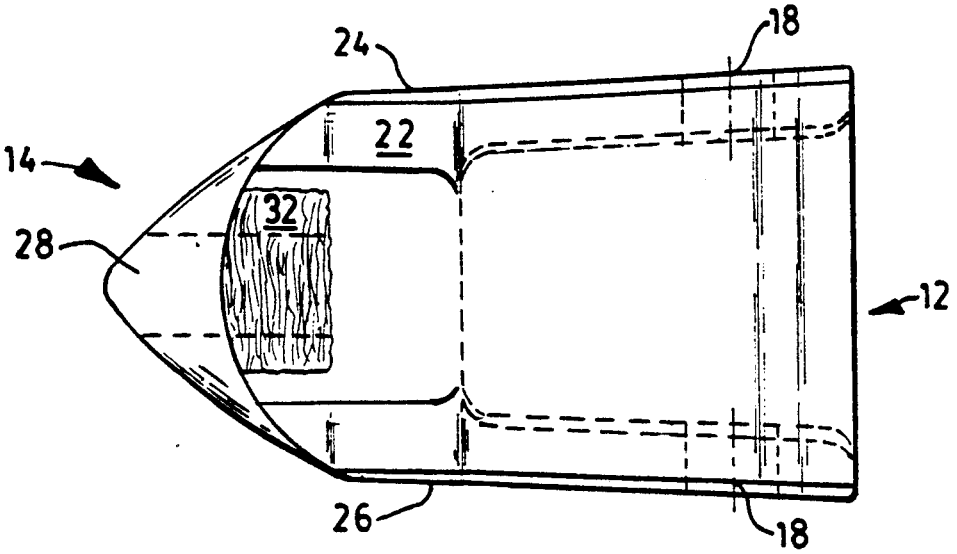
FIG. 7 is a bottom view of the heavily worn tooth illustrated in FIG. 6.

Referring now to FIGS. 6 and 7, the tooth 10 is shown to illustrate theoretically the wear pattern of the tooth after further use. Noting again, the greater wear is to the bottom surface 22 while the top surface 20 has less wear. Once again, the side portions 24,26 have worn away to help maintain the sharp point for better penetration.

Figure 8:
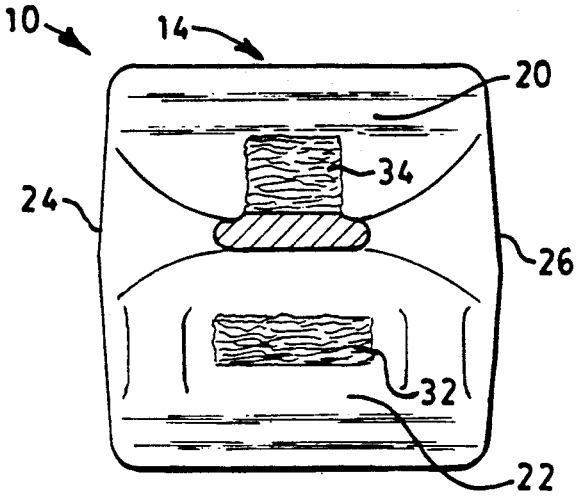
FIG. 8 is a view 8—8 taken from FIG. 4 and incorporating the full width of the tooth.
Figure 9:
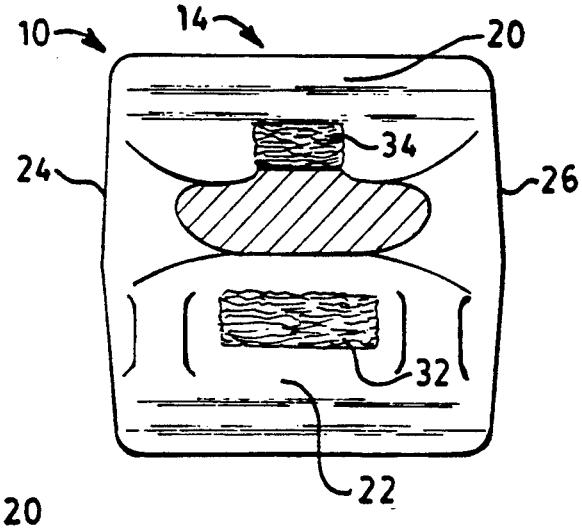
FIG. 9 is a view 9—9 taken from FIG. 4 and incorporating the full width of the tooth.
Figure 10:
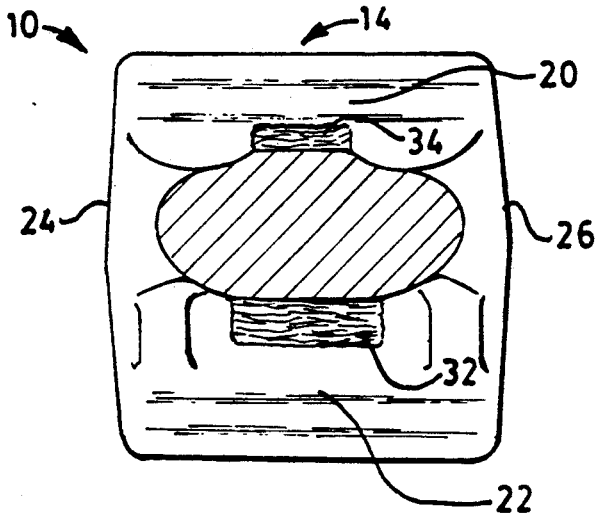
FIG. 10 is a view 10—10 taken from FIG. 4 and incorporating the full width of the tooth.

Referring now to FIGS. 8, 9, and 10, each of these figures are sectional views taken from the partially worn tooth 10 of FIG. 4 to further illustrate theoretically the wear pattern of the tooth 10. These figures progressively illustrate how the side surfaces 24,26 wear to help provide the sharpness necessary to better aid the tooth 10 in the penetration of the material being worked.

Even though, in the subject embodiment, the relationship of the width $W_1$ of the first portion of hard material 32 with respect to the width $W_2$ of the second portion of hard material 34 is two-to-one, it is recognized that this relationship could be varied depending on the type of abrasive material being worked. However, it is believed that the width $W_1$ of the first portion of hard material 32 should be wider than the width $W_2$ of the second portion of hard material 34. Since the application of hard material to respective surfaces of the tooth 10 is expensive, it is believed that the lengths $L_1$,$L_2$ of the first and second portions of hard material 32,34 should be generally the same. However, it is recognized that depending on the material being worked the lengths thereof could vary somewhat.

INDUSTRIAL APPLICABILITY

In use, the tooth 10 is mounted on an implement, such as a loader bucket, and is used to penetrate the material being loaded into the bucket. The bottom surface 22 is in intimate contact with the material being worked and receives the greatest wear from the abrasive contact with the material being worked. The top surface 20 receives wear from the material sliding thereacross during entry of the material into the bucket. The side surfaces 24,26, being unprotected, receive wear from material being directed to either side thereof and would wear at a faster rate than that of the protected top surface 20. By adding the first portion of hard material to the bottom surface, the wear rate of the bottom surface 22 is significantly decreased. Likewise, by adding the second portion of hard material 34 to the top surface 20, the wear rate of the top surface is significantly decreased. Since the application of hard material to the surface is quite expensive, it is beneficial to apply only the amount needed to achieve the desired objectives. It is not economical or practical to apply hard material to the entire top, bottom, and/or side surfaces of the tooth 10.

By applying the first portion of hard material 32 having the predetermined width $W_1$ and length $L_1$ to the bottom surface 22 of the tooth 10 and the second portion of hard material 34 having the predetermined width $W_2$ less than the width $W_1$ of the first portion of hard material 34 to the top surface 20, the wear life of the tooth 10 is extended and due to the strategic placement and sizing of the first and second portions of hard material 32,34, the wear of the tooth 10 is controlled to maintain the sharpness of the tooth 10 during its useful life.

FIG. 4 better exemplifies the theoretical wear pattern of the subject embodiment. Note that the bottom surface 22 wears at a quicker rate than the top surface 20. By having the first portion of hard material 32 extend into the cavity 30, the part of the first portion of hard material located in the cavity 30 is protected by the sides of the cavity from wear and harsh impacts during the early life of the tooth 10. Further, when referring to FIGS. 8, 9, and 10 in conjunction with FIG. 5, the side surfaces 24,26 wear away to further aid in establishing a sharper point on the tooth 10 to promote better penetration. If the top surface 20 and the bottom surface 22 were to wear at the same rate, the tooth 10 would become blunt and lose its ability to more easily penetrate the material being worked.

FIGS. 6 and 7 further represents the theoretical wear pattern of the tooth 10 as its useful life is being consumed. Once the first portion of hard material 32 is entirely worn away from the bottom surface 22, the second portion of hard material 34 on the top surface 20 continues to wear. It is desirable, once the tooth 10 has fulfilled its total useful life, that the second portion of hard material 34 is also totally consumed. Consequently, all of the more expensive hard material is utilized during the useful life of the tooth 10 and not thrown away with a tooth that can no longer be used.

In view of the foregoing, it is readily apparent that the tooth 10 of the subject invention with its applied first and second portions of hard material 32,34 strategically located and sized provides a tooth 10 having both extended wear life and better penetrating ability throughout its useful life.

Other aspects, objects, and advantages of this invention can be obtained from a study of the drawings, the disclosure, and the appended claims.

We claim:

1. A tooth adapted for use on an implement to work earthen material, the tooth comprising:

a proximal end portion adapted for attachment of the tooth to the implement;

a distal end portion having a top surface, a bottom surface, opposed side surfaces, and a transverse forward edge having a predetermined width, each of the surfaces extending longitudinally form the proximal end portion to the transverse forward edge, the top surface and the bottom surface converge at the transverse forward edge to form a sharp edge for better penetration;

a first portion of hard wear resistant material having a predetermined width and length applied to the bottom surface at a location extending form adjacent the transverse forward edge longitudinally towards the proximal end portion, the predetermined width of the first portion of hard material being less than the predetermined width of the transverse forward edge; and a second portion of hard material having a predetermined width and length applied to the top surface at a location extending from adjacent the transverse forward edge longitudinally towards the proximal end portion, the predetermined width of the second portion of hard material being less than the predetermined width of the first portion of hard material, the first portion of hard material in cooperation with the second portion of hard material being operative during the life of the tooth to both increase the wear resistance of the tooth and maintain the sharp edge of the tooth for better penetration of the material being worked.

2. The tooth of claim 1 wherein a longitudinally extending cavity is defined in the bottom surface of the distal end portion and the first portion of hard material extends into the cavity.

3. The tooth of claim 2 wherein the predetermined length of the second portion of hard material is generally the same as the predetermined length of the first portion of hard material.

4. The tooth of claim 3 wherein the longitudinally extending cavity is spaced from the transverse forward edge and centrally located between the opposed side surfaces.

5. The tooth of claim 4 wherein the first and second portions of hard material are centrally located between the opposed side surfaces.

6. The tooth of claim 5 wherein the longitudinally extending cavity has a width wider than the predetermined width of the first portion of hard material.

7. The tooth of claim 6 wherein the first and second portions of hard materials are applied by bonding the hard material to the top and bottom surfaces.

8. The tooth of claim 7 wherein the bonding of the first and second portions of hard material to the top and bottom surfaces is accomplished by adding hard particles to a weld puddle created during the application of a weld material to the top and bottom surfaces.

9. The tooth of claim 8 wherein the predetermined width of the first portion of hard material is generally two times wider than the predetermined width of the second portion of hard material.

10. The tooth of claim 9 wherein the opposed side surfaces of the distal end portion are generally parallel.

* * * * *